United States Patent [19]

Curran

[11] 4,101,073

[45] Jul. 18, 1978

[54] TWO-FLUID SPRAY NOZZLE PRODUCING FINE ATOMIZATION OF LIQUID

[75] Inventor: James Hall Curran, North Chelmsford, Mass.

[73] Assignee: Spray Engineering Company, Nashua, N.H.

[21] Appl. No.: 827,701

[22] Filed: Aug. 25, 1977

[51] Int. Cl.[2] ..... F25C 3/04

[52] U.S. Cl. ..... 239/14; 239/431; 239/432

[58] Field of Search ..... 239/2 S, 14, 403, 425, 239/430, 431, 432

[56] References Cited

U.S. PATENT DOCUMENTS

| | | | |
|---|---|---|---|
| 2,090,150 | 8/1937 | Pontius | 239/425 |
| 2,676,471 | 4/1954 | Pierce | 239/2 S X |
| 3,829,013 | 8/1974 | Ratnik | 239/14 |
| 3,908,903 | 9/1975 | Burns | 239/14 X |

*Primary Examiner*—Johnny D. Cherry

*Attorney, Agent, or Firm*—Robert P. Outerbridge

[57] ABSTRACT

A spray nozzle in which a plurality of streams of water under pressure are initially broken up mechanically within a chamber by impingement against a deflector therein and by the shearing action of its knife edge, and are then atomized and initially cooled within the chamber by jets of expanding compressed air, the cooled air and atomized water mixture then being discharged from an annular orifice in the form of a hollow cone spray in which the atomized water is further cooled by reason of the temperature drop in the discharged air because of its expansion upon discharge. This results in the formation of snow flakes where the ambient atmospheric temperature is sufficiently low to effect freezing of the discharged atomized water.

6 Claims, 9 Drawing Figures

TWO-FLUID SPRAY NOZZLE PRODUCING FINE ATOMIZATION OF LIQUID

BACKGROUND AND SUMMARY OF THE INVENTION

While embodiments of the present invention may be used for a variety of purposes where it is desired to atomize a liquid by means of a gas, for purposes of disclosure the present invention is herein described as relating primarily to spray nozzles for making snow in flake form for use in covering ski areas and the like for winter sports when natural snowfall has been scanty because of variations in accumulations over a sports season or when it is desired to supplement natural snowfall to make existing surfaces better for sports enthusiasts. The growth of interest in winter sports over the past twenty five years and the increase in the number of participants during that time have, on the one hand, created a considerable business in such sports activity and, on the other hand, created an increased demand for apparatus for artificially making snow to counteract light snowfall and its adverse sports and economic effects.

There has been considerable development in the art since the issuance of what may be called the basic Pierce U.S. Pat. No. 2,676,471 on Apr. 27, 1954 (application filed Dec. 14, 1950) and as well summarized in the Burns U.S. Pat. No. 3,908,903, issued Sept. 30, 1975, the Pierce nozzle (like the nozzle of the present invention) utilizes compressed air mixed with pressurized water for the two purposes of atomizing the water into small droplets and to produce small ice crystals which act as "seeds" to crystallize the droplets into snow, the droplets having been cooled by exposure to the subfreezing ambient air. The Burns patent lists some thirteen U.S. patents all directed to making snow in various ways, and other patents issuing before and after Burns include Ratnik, U.S. Pat. Nos. 3,829,013, Aug. 13, 1974; Tropeano, 3,831,844, Aug. 27, 1974; White, 3,923,247, Dec. 2, 1975; and Hanson, 4,004,732, Jan. 25, 1977.

A constant problem facing all snow making has been the large quantity of compressed air required to produce a desired quantity of snow, and a further problem has been the noise factor which attends the use of such air. It is therefore the principal object of the present invention to produce snow-making nozzle structure for atomizing water by the use of compressed air in the operation of which the ratio of air to water is low and as a result of which the noise produced in operation of the nozzle is reduced by almost two thirds over conventional nozzles. Actual tests of nozzles embodying the present invention in operation in an ambient temperature of 28° F have shown a 5-to-1 air to water ratio, which is much lower than the prior art has produced at such ambiance under the same conditions.

But embodiments of the present invention may also be used under ambient temperature conditions which are not below or near the freezing point of water but higher to any extent, and a few examples of such uses are: (a) spray drying in the production of soap powder with air being the atomizing agent; (b) cooling gases, as in the manufacture of cement, where the water droplets used for cooling must be in such fine atomization as to evaporate and not contact the cement; and (c) combustion of fuel oils with either air or steam being used to atomize the fuel.

It is therefore a further object of the present invention to produce improved nozzle structure which creates a fine atomization of liquid by means of a pressurized gas for a variety of purposes where the ambient temperatures are at any points above that of water freezing.

To the accomplishment of the above-mentioned objects the various features of the present invention reside in certain constructions, combinations, and arrangements of parts all fully described in the following detailed description of two embodiments and are then set forth in the appended claims by the intentional use of generic terms and expressions that are inclusive in meaning of various modifications.

DETAILED DESCRIPTION OF TWO EMBODIMENTS OF THE INVENTION

Figure 1:
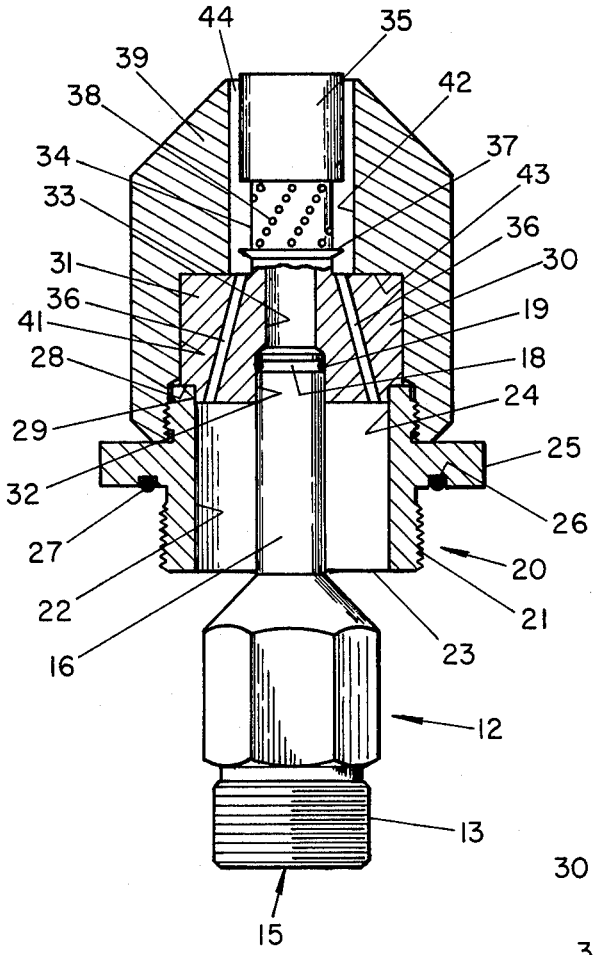
FIG. 1 is a view in elevation, partially in section, of one embodiment of the present invention showing the various parts assembled.
Figure 2:
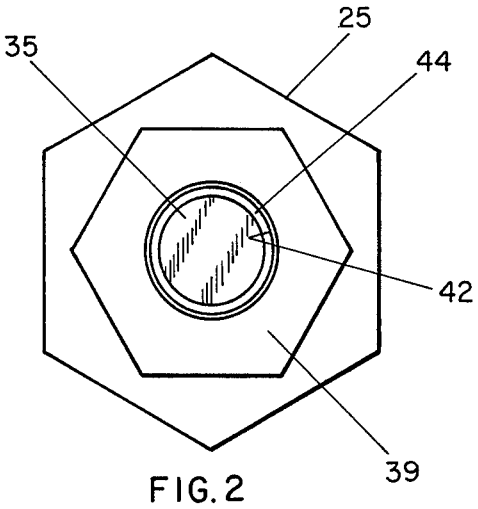
FIG. 2 is a view in plan of the embodiment shown in FIG. 1.

Referring to the drawings, the embodiment of the present invention shown in FIGS. 1–8 is provided with a base member 12 (FIGS. 1 and 6) shown merely for illustrative purposes as made from hex stock and provided with a male threaded end portion 13 for attachment to a source of compressed air. The base member 12 is provided with a cylindrical through passage 14 (FIG. 6) leading from an inlet 15 at one end for the compressed air, and at its opposite end the base member terminates in an open-ended, integral hollow post portion 16 outstanding therefrom, with the hollow interior 17 of the post being an axial continuation of the through passage 14 in the base member. Adjacent its free and open end the hollow post 16 is provided with an annular groove 18 (FIG. 6) for the reception of an O-ring 19 (FIG. 1).

In one application of embodiments of the present invention it is contemplated that they be associated and utilized in connection with the jet structure J illustrated in the above-mentioned Tropeano patent No. 3,831,844. Stating this differently, it is contemplated that examples of the herein disclosed FIGS. 1–8 embodiment of the present invention be substituted for the nozzle members N1 and N2 of the Tropeano patent disclosure, and for this purpose the end portion 13 of the base member 12 is given a male thread for mounting on either of the air duct portions D1 and D2 of the respective manifold members M1 and M2 best shown in FIG. 4 of the Tropeano patent.

In order further to adapt embodiments of the present invention for use in connection with the Tropeano jet structure J, the embodiment of the present invention shown in FIGS. 1–8 is provided with a body member 20 (FIGS. 1 and 8) having at its lower end (viewing these two FIGS.) a male threaded portion 21 for mounting in the discharge end portions of the Tropeano manifold members M1 or M2, the function of which is to supply pressurized water to the nozzle members N1 and N2. To this end the body member 20 is illustrated as having a cylindrical interior 22 of appreciably greater diameter than that of the exterior of the post portion 16, providing an inlet 23 for receiving pressurized water and an outlet 24 for its flow to a distributor, as will be described. In order to facilitate mounting the body member 20 on the Tropeano manifold members M1 and M2 the member 20 is provided with a hex portion 25 (FIGS. 1, 2, and 8) to make wrench flats, and the under portion (viewing FIGS. 1 and 8) of the hex 25 is provided with an annular groove 26 to receive an O-ring 27 adapted to be pressed against the open end of the manifold members M1 and M2 of the Tropeano disclosure, thereby effecting a seal against water leakage when the body member 20 is mounted in operative position.

Resting on the outlet 24 of the body member 20 is the shoulder 28 formed by the reduced end portion 29 (FIGS. 1 and 3) of an air and water distributor indicated generally by the numeral 30, and which will now be described. The distributor 30 is provided with a base portion 31 integral with its reduced end portion 29, and interiorly the distributor is provided with a passage 32 for receiving the free end of the hollow post portion 16 of the base member 12 in lateral sealing engagement therewith by reason of the O-ring 19 (FIG. 1). Downstream from the passage 32 the distributor base 31 is provided with an axial passage 33 of reduced diameter leading from the passage 32, and further downstream from the base 31 proper there is provided an integral hollow post 34 having a cylindrical closed free end portion 35 of increased exterior diameter, for a purpose which will be described. As best shown by considering FIGS. 3 and 6 in connection with FIG. 1, the closed-ended hollow post portion 34 of the distributor 30 forms an axial continuation of the hollow post 16 outstanding from the base member 12.

It will be appreciated that with the threaded end portion 13 of the base member 12 mounted in an air duct portion D1 or D2 of the Tropeano disclosure, and with the threaded inlet 21 of the body member 20 mounted in the discharge portion of the Tropeano manifold members M1 or M2, the cylindrical passage 32 in the distributor 30 will fit over the open and free end of the hollow post portion 16 and receive the O-ring 19, as shown in FIG. 1.

Figure 3:
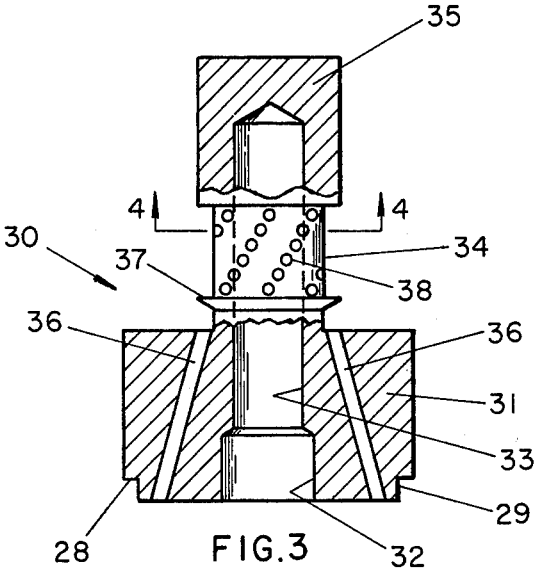
FIG. 3 is an enlarged view in elevation, partially in section, of the air and water distributor shown in FIG. 1.

So that the distributor 30 may perform its water-distributing function, the base 31 is provided with an annular arrangement of passages 36, herein shown as twelve in number merely for illustrative purposes, each passage being located exteriorly of the post portion 34 and leading from an area adjacent the outer edge of the distributor reduced end portion 29 and extending downstream angularly inwardly (FIGS. 1 and 3) toward the hollow post portion 34. Located in the paths of discharge from the passages 36 is an annular shoulder 37 integral with the post portion 34 and functioning as a turbulence-producing deflector by reason of the impact of the water streams against it. As best shown in FIG. 3, the deflector 37 is preferably frusto-conical in shape with the larger base located downstream so as to provide a rim knife edge which causes further turbulence in the water streams discharged from the passages 36 because of the shearing action of the knife edge in engagement with said streams.

Figure 4:
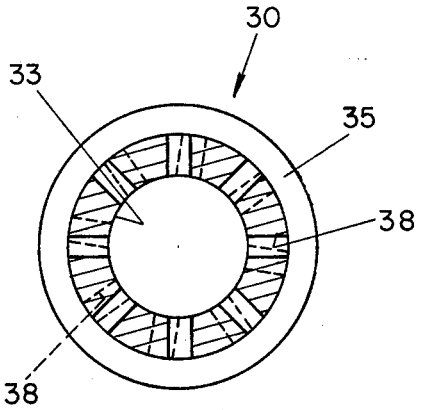
FIG. 4 is an enlarged view in section taken along the line 4—4 of FIG. 3.
Figure 5:
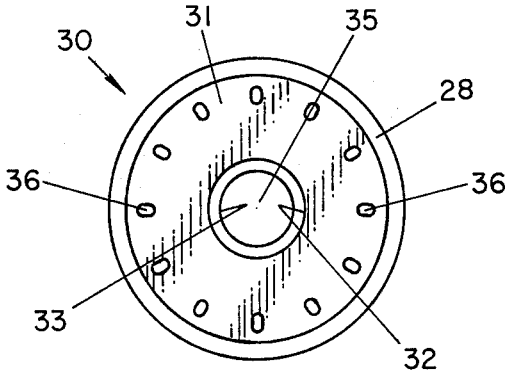
FIG. 5 is a view in underside plan of the air and water distributor as shown in FIG. 3.
Figure 6:
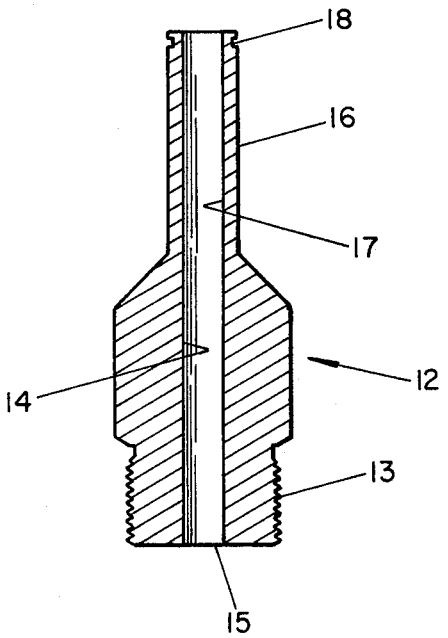
FIG. 6 is a view in sectional elevation of the base member shown in FIG. 1.
Figure 7:
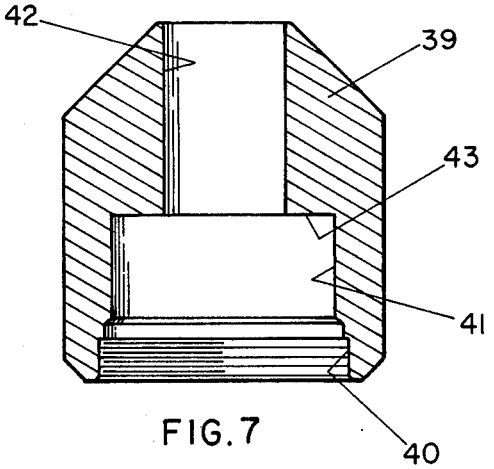
FIG. 7 is a view in sectional elevation of the cap shown in FIG. 1.
Figure 8:
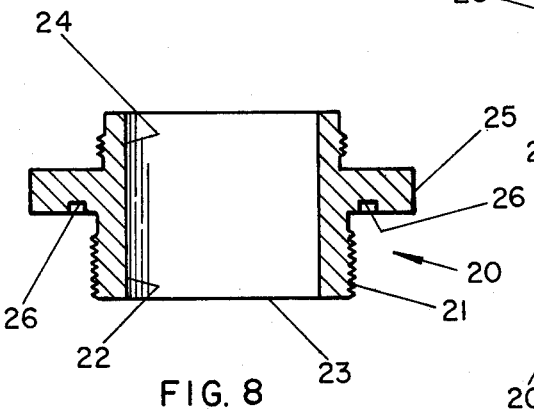
FIG. 8 is a view in sectional elevation, somewhat reduced in size, of the body member shown in FIG. 1.

So that the distributor 30 may perform its air-distributing function, the hollow post portion 34 thereof between the annular shoulder 37 and the closed end portion 35 is provided with annular rows of passages 38 leading outwardly from its interior. As illustrated in FIGS. 1 and 3, there are six rows of these passages 38 and as indicated in FIG. 4 there are eight passages in each row, spaced 45° apart. Moreover, the passages 38 in the successive rows are offset in echelon in a line of bearing at an angle to the longitudinal axis of the hollow post portion 34, this angularity being 9° as between corresponding passages 38 in each successive pair of rows, and since the angularity is 9° it will be seen that with six rows (FIGS. 1 and 3) the air passages 38 in the most upstream row are aligned axially with the air passages 38 in the most downstream row. The diameter of each passage 38 is preferably such that the sum of the cross sectional areas of all of the air passages 38 considered as a group is not greater than the cross sectional area of the passage 33, and this size and echelon arrangement provides for optimum atomization of the water, as will be described.

The structure illustrated in FIGS. 1–8 is completed by a cap 39 (FIGS. 1, 2, and 7) having an interiorly threaded upstream portion 40 adapted to be mounted on the inlet 24 of the body member 20, and also provided with a cylindrical interior 41 adapted to surround the distributor base 31. Downstream from the cylindrical interior 41 the cap 39 is provided with a passage 42 of reduced diameter to provide a shoulder 43 which abuts the distributor base 31 when in position (FIG. 1) and holds it in place, and the passage 42 is of appreciably greater diameter (FIG. 1) than that of the hollow post portion 34 and substantially encloses said portion 34, thereby providing a chamber for mixing air from the passages 38 and pressurized water from the passages 36, as will be described. As also shown in FIG. 1, the diameter of the cap passage 42 is greater than that of the closed end portion 35 of the distributor 30, thereby providing an annular discharge orifice 44 (FIGS. 1 and 2) because the closed end portion 35 preferably extends substantially to the mouth of the cap passage 42, and is shown in FIG. 1 as extending slightly beyond.

Disregarding at this point in this disclosure snow making and its related all-important variable factors of (a) air pressure, temperature, and volume; (b) water pressure, temperature, and volume; (c) ambient temperature; and (d) humidity conditions, the water which enters the body member inlet 23 under pressure passes out through the distributor passages 36 as jets and each jet strikes the annular shoulder 37 and is initially broken up mechanically thereby and by the shearing action of the knife edge into droplets, the extent of this breaking up into droplets being a direct factor of the pressure of the jets and their impact force. After passing the shoulder 37 knife edge the droplets are struck by the air jets issuing from the echelon rows of passages 38 in the distributor hollow post portion 34, and since these air jets expand upon being released from the interior of the hollow post portion 34 the echelon arrangement of these passages 38 causes what is substantially a wall of atomizing air to be formed by reason of its expansion so that the air contacts all the droplets to atomize them. The passage 42 portion within the cap 39 and the adjacent exterior surface of the hollow post portion 34 thus form an atomizing mixing chamber, as it were, for the air and water droplets, and thereafter the atomized droplets flow outwardly between the passage 42 and the closed end 35 of the hollow post portion 34 and are discharged in a hollow cone spray from what is in effect an annular discharge orifice by reason of this construction.

Considering now snow making and the above-mentioned related variable factors, it has been found that in order to produce snow the ambient temperature had best be not higher than 30° F and preferably not higher than 28° F since at higher temperatures there is a tendency for the snow, if produced, to be very wet, while at ambient temperatures not higher than 28° F the atomized water droplets readily freeze into ice crystals which "seed" and agglomerate into snow. It has also been found that if the ambient humidity is high the greater the cubic feet of air consumed per gallon of water consumed while under low humidity conditions less cubic feet of air per gallon of water are consumed and the greater is the consumption of water. The foregoing presumes, of course, that under each ambient humidity condition the air pressure and the water pressure are unchanged. So far as pressures for the air and water are concerned, it has been found that with air pressure of 90 psig at the nozzle inlet 15 and water pressure of 125 psig at the nozzle inlet 23 actual tests of embodiments of the present invention under 28° F ambient temperature conditions resulted in 20 GPM of water initially at 67° F at the pump being converted at the nozzle into snow with only 100 CFM of air, a 5-to-1 ratio, and prior art constructions produce such a low ratio only where the ambient temperature is on the order of −10° or −20° F. Where the ambient temperature is in the order of 10° or 20° or 30° F, increased air consumption or increased water consumption, depending upon the ambient humidity, in the use of prior art constructions is accompanied by a higher air to water ratio, and this produces a noise level appreciably greater than that caused by embodiments of the present invention where the air to water ratio can be as low as 5-to-1.

It will be appreciated that in the operation of the embodiment of the present invention shown in FIGS. 1–8, the turbulent water droplets formed by impingement of the jets from the passages 36 against the annular shoulder-deflector 37 and the shearing action of its knife edge are initially cooled and atomized within the mixing chamber by contact with the compressed air being discharged and expanding from the passages 38 and which is itself cooled by reason of the temperature drop which the expansion produces, and it will also be appreciated that the cooled water droplets atomized by the air from the passages 38 are further cooled by the temperature drop resulting from the air expansion in the air and atomized water mixture as it is discharged from the annular orifice 44 into the ambient atmosphere as a hollow cone spray. Where the ambient atmosphere is, say, 28° or less, the formation of snow flakes is readily accomplished.

Figure 9:
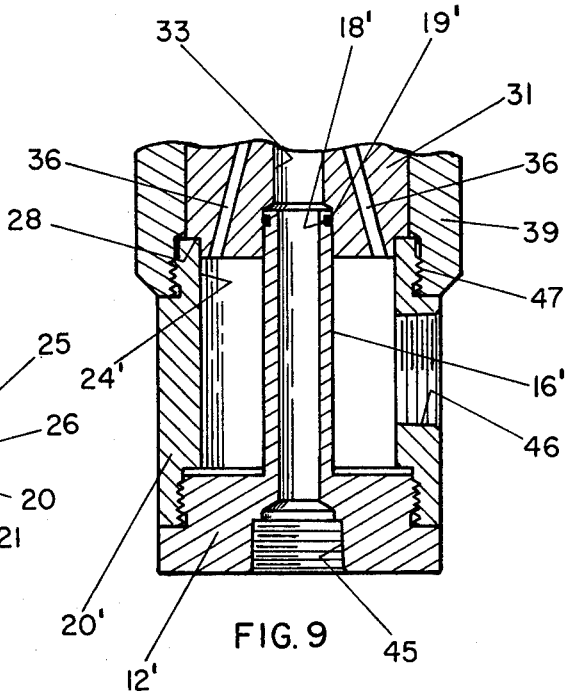
FIG. 9 is a detail view in sectional elevation of a modified embodiment of the present invention, illustrating different base and body members which may be associated with the illustrated distributor and cap without any change therein.

As brought out above, the structure illustrated in FIGS. 1–8 is made as it is for use in connection with the jet structure J illustrated in the Tropeano U.S. Pat. No. 3,831,844. But the present invention is not limited to use in that locus, as it is not necessary for the present invention that embodiments thereof have the air and water inlet structure illustrated in FIGS. 1–8. What may be called conventional air and water inlet structure is illustrated in FIG. 9, in which a base member 12' corresponds to the base member 12 in FIGS. 1–8 but has an interiorly threaded passage 45 for connection to any suitable source of compressed air. Outstanding from the base 12' in FIG. 9 is a hollow post portion 16' corresponding to the post portion 16 with the hollow interior of the post portion 16' being an axial continuation of the passage 45. Threaded on a reduced portion of the base member 12' is a body member 20' which corresponds to the body member 20 in FIGS. 1 and 8, and laterally the FIG. 9 body member 20' is provided with a threaded inlet 46 for connection to any suitable source of water under pressure. The downstream or open end of the body member 20' in FIG. 9 has a threaded portion 47 for the reception of the cap 39, and the shoulder 28 of the distributor 30 rests on the outlet end 24' of the body member 20' in the same manner as it rests on the outlet 24 of the body member 20. Completing the structure of the FIG. 9 hollow post portion 16' are an annular groove 18' and O-ring 19' corresponding in structure and function to the annular groove 18 and O-ring 19 in FIG. 1. The operation of the FIG. 9 embodiment is the same as that of the FIGS. 1–8 embodiment.

What is claimed as new is:

1. A spray nozzle comprising:

(a) a base member having an inlet for air under pressure leading to an open-ended hollow post outstanding from the base member;

(b) a body member associated with the base member for the reception of water under pressure and for the flow of the water out of the body member;

(c) a distributor associated with the body member and having a closed-ended hollow post portion forming an axial continuation of the hollow post outstanding from the base member, (i) the distributor also being provided with a base having an annular arrangement of water passages located exteriorly of the hollow post continuation portion to receive the water flowing out of the body member, (ii) the distributor also being provided with a shoulder forming a knife-edged deflector in the paths of discharge of water from the distributor base passages, (iii) the distributor hollow post continuation portion being provided with annular rows of passages leading from its interior and located downstream from the shoulder for the discharge of air outwardly into the water deflected by the knife-edged shoulder; and (d) a cap associated with the body member substantially enclosing the distributor hollow post continuation portion in spaced relation thereto and provided with a discharge orifice, said cap and continuation portion forming a mixing chamber for the air and water prior to discharge from said orifice.

2. Structure according to claim 1 in which the closed end of the hollow post continuation portion extends to the mouth of the cap orifice, thereby providing what is in effect an annular discharge orifice.

3. Structure according to claim 1 in which the distributor base passages are directed downstream angularly inwardly toward said shoulder.

4. Structure according to claim 1 in which the annular rows of air passages in the hollow post continuation portion are successively offset in echelon in a line of bearing at an angle to the longitudinal axis of said hollow post continuation portion.

5. Structure according to claim 4 in which the air passages in the most upstream row are axially aligned, respectively, with the air passages in the most downstream row.

6. Structure according to claim 4 in which the air passages in each annular row are spaced 45° apart and in which the offset angularlity in echelon as between corresponding passages in each successive pair of rows is 9°.

* * * * *